US008733907B2

(12) United States Patent
Saito et al.

(10) Patent No.: US 8,733,907 B2
(45) Date of Patent: May 27, 2014

(54) LIQUID DISCHARGE HEAD AND METHOD FOR MANUFACTURING LIQUID DISCHARGE HEAD

(75) Inventors: Akio Saito, Machida (JP); Hiromitsu Morita, Sakado (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/701,187

(22) PCT Filed: May 16, 2011

(86) PCT No.: PCT/JP2011/002713

§ 371 (c)(1),
(2), (4) Date: Nov. 30, 2012

(87) PCT Pub. No.: WO2011/155129

PCT Pub. Date: Dec. 15, 2011

(65) Prior Publication Data

US 2013/0088548 A1 Apr. 11, 2013

(30) Foreign Application Priority Data

Jun. 10, 2010 (JP) ..... 2010-133020

(51) Int. Cl.
*B41J 2/045* (2006.01)

(52) U.S. Cl.
USPC ..... 347/68; 347/69; 347/71; 347/50; 347/58

(58) Field of Classification Search
USPC ..... 347/68, 69, 71, 50, 58; 29/25.35
See application file for complete search history.

(56) References Cited

U.S. PATENT DOCUMENTS 7,622,855 B2 11/2009 Seto
2007/0018540 A1 1/2007 Seto

FOREIGN PATENT DOCUMENTS

| | | | |
|---|---|---|---|
| DE | 33 24 043 | A1 | 1/1985 |
| EP | 1 923 219 | A2 | 5/2008 |
| JP | 58-153662 | A | 9/1983 |
| JP | 1-130950 | A | 5/1989 |
| JP | 2004-58505 | A | 2/2004 |
| JP | 2006-327163 | A | 12/2006 |
| JP | 2007-30260 | A | 2/2007 |
| JP | 2007-168319 | A | 7/2007 |

OTHER PUBLICATIONS

International Preliminary Report on Patentability dated Dec. 10, 2012, in International Application No. PCT/JP2011/002713.
International Search Report and Written Opinion of the International Searching Authority in PCT/JP2011/002713.
Office Action dated Jan. 14, 2014, in Japanese Application No. 2010-133020.

*Primary Examiner* — Henok Legesse
(74) *Attorney, Agent, or Firm* — Fitzpatrick, Cella, Harper & Scinto

(57) ABSTRACT

A liquid discharge head includes piezoelectric members including: a pressure chamber applying a pressure for discharging liquid to liquid; a first electrode provided on an inner surface side of the pressure chamber; and a second electrode provided outside the pressure chamber, the piezoelectric members being arranged in a first direction intersecting with an ink flow direction and in a second direction crossing the ink flow direction and the first direction so that the flow directions of the liquid flowing through the pressure chamber of the piezoelectric members are arranged along one another. The head includes first common wiring lines connected to the first electrodes arranged in the first direction; and second common wiring lines connected to the second electrodes 23 arranged in the second direction. The first common wiring lines are arranged in the second direction and the second common wiring lines are arranged in the first direction.

20 Claims, 7 Drawing Sheets

LIQUID DISCHARGE HEAD AND METHOD FOR MANUFACTURING LIQUID DISCHARGE HEAD

TECHNICAL FIELD

The present invention relates to a liquid discharge head for discharging liquid and a method for manufacturing the liquid discharge head.

BACKGROUND ART

Conventionally, an ink jet recording apparatus which discharges ink on a recording medium to record an image has been known as a recording apparatus. The ink jet recording apparatus incorporates a liquid discharge head for discharging ink.

As a mechanism for discharging ink from the liquid discharge head, there is known a piezoelectric member which introduces and discharges ink by changing the volume of a pressure chamber included in the liquid discharge head. The pressure chamber is provided with a liquid supply channel for supplying ink to the pressure chamber, and nozzles for discharging ink from the pressure chamber. When the volume of the pressure chamber is contracted, the ink contained in the pressure chamber is discharged as ink droplets from the nozzles, and when the volume of the pressure chamber is expanded, the ink is introduced into the pressure chamber from the liquid supply channel.

The piezoelectric member is composed of a diaphragm that forms at least one wall surface of the pressure chamber and a piezoelectric element provided on the diaphragm. The volume of the pressure chamber can be expanded or contracted by deforming the piezoelectric element.

In particular, a cylindrical piezoelectric member has been previously proposed in which a cylindrical piezoelectric element is used to form a pressure chamber. The cylindrical piezoelectric member contracts toward the center in a radial direction of the cylindrical shape. Accordingly, the ink accumulated in the pressure chamber is uniformly pressurized in a direction toward the center from the outer periphery of the piezoelectric member. This allows the ink to be discharged from the nozzles with a larger flying force.

Meanwhile, in order to obtain a higher resolution while maintaining a printing speed in performing printing with the liquid discharge head using the piezoelectric member, it is necessary to dispose multiple nozzles at a higher density in the liquid discharge head. Correspondingly, the piezoelectric members provided in association with the respective nozzles are required to have a structure that is small and can be disposed at a high density.

In this regard, PTL 1 discloses a liquid discharge head in which multiple cylindrical piezoelectric members are arranged in a staggered two-dimensional matrix form, thereby increasing the density of nozzles. PTL 1 also discloses a method for manufacturing the liquid discharge head in which a piezoelectric material is filled in a mold having multiple recesses and the piezoelectric members are integrally formed. The integral formation of the piezoelectric members can improve accuracy of the layout of the nozzles and simplify a process for manufacturing the piezoelectric members.

PTL 2 discloses, as a method for manufacturing a liquid discharge head in which piezoelectric members are disposed at a high density, a method for stacking multiple plates each having multiple grooves with groove extending directions aligned with each other and cutting the plates in a direction perpendicular to the groove extending direction. The plates are each formed of a piezoelectric material, and each groove portion serves as a pressure chamber.

In the manufacturing method disclosed in PTL 2, a pressure chamber having a greater depth than the manufacturing method disclosed in PTL 1 can be formed while the density of the disposed nozzles is maintained. The volume of the pressure chamber and the amount of contraction thereof can be increased by increasing the depth of the pressure chamber. Accordingly, both the flying force of ink and the high-density layout of nozzles can be obtained.

CITATION LIST

Patent Literature

PTL 1: Japanese Patent Application Laid-Open No. 2006-327163

PTL 2: Japanese Patent Application Laid-Open No. 2007-168319

SUMMARY OF INVENTION

Technical Problem

However, in the liquid discharge heads disclosed PTL 2 and PTL 1, wiring lines are connected to the respective electrodes provided in the piezoelectric members. A space for the routed wiring lines and a space for the electrodes connected with the wiring lines are required, which inhibits an increase in the density of the piezoelectric members. Further, a number of wiring lines corresponding to the number of electrodes of the piezoelectric members are required, which causes an increase in costs.

Furthermore, at the time of manufacturing a liquid discharge head, wiring lines are required to be disposed at a high density, resulting in deterioration in production yield.

Solution to Problem

A main object of the present invention is to provide a liquid discharge head capable of increasing the density of piezoelectric members to be disposed, and a method for manufacturing the same.

The present invention has been made in view of the aforementioned technical problems, and has the following configurations.

A liquid discharge head according to the present invention includes a plurality of piezoelectric members each including: a pressure chamber for applying a pressure for discharging liquid to the liquid; a first electrode provided on an inner surface side of the pressure chamber; and a second electrode provided outside the pressure chamber, the piezoelectric members generating the pressure by being deformed using the first electrode and the second electrode and being arranged in a first direction intersecting with a liquid flow direction and in a second direction intersecting with each of the liquid flow direction and the first direction so that the flow directions of the liquid flowing through the pressure chambers of the piezoelectric members are arranged along one another. The liquid discharge head includes: a plurality of first common wiring lines commonly connected to the plurality of first electrodes arranged in the first direction; and a plurality of second common wiring lines commonly connected to the plurality of second electrodes arranged in the second direction. The plurality of first common wiring lines is arranged in the second direction, and the plurality of second common wiring lines is arranged in the first direction.

Further, the present invention provides a method for manufacturing a liquid discharge head, the liquid discharge head including: a plurality of piezoelectric members each including a pressure chamber for applying a pressure for discharging liquid to liquid, a first electrode provided on an inner surface side of the pressure chamber, and a second electrode provided outside the pressure chamber, the piezoelectric members generating the pressure by being deformed using the first electrode and the second electrode; and a base member adjacent to the piezoelectric members, the piezoelectric members each including: a first surface having an inlet for introducing the liquid into the pressure chamber; and a second surface positioned on an opposite side of the first surface and having an outlet for discharging the liquid from the pressure chamber, a first surface of the base member being adjacent to the first surface of each of the piezoelectric members, a second surface of the base member on an opposite side of the first surface having an opening communicating with each of the pressure chambers, the plurality of piezoelectric members being arranged in a first direction intersecting with a liquid flow direction and in a second direction intersecting with each of the liquid flow direction and the first direction so that the flow directions of the liquid flowing through the pressure chambers of the piezoelectric members are arranged along one another, the liquid discharge head including: a plurality of first common wiring lines commonly connected to the plurality of first electrodes arranged in the first direction; and a plurality of second common wiring lines commonly connected to the plurality of second electrodes arranged in the second direction, the plurality of first common wiring lines being formed on the second surface of the base member, the plurality of second common wiring lines being formed on the first surface of the base member. The method includes the steps of: forming an electrode film on an entire surface of each of the piezoelectric members and the base member; removing the electrode film formed on the second surface of each of the piezoelectric members to separate the first electrodes from the second electrodes; removing the electrode film formed on a side surface of the base member between the first surface of the base member and the second surface of the base member to separate the first common wiring lines from the second common wiring lines; forming the first common wiring lines by removing along the first direction the electrode film formed between openings adjacent to each other in the second direction on the second surface of the base member; and forming the second common wiring lines by removing along the second direction the electrode film formed between the piezoelectric members adjacent to each other in the first direction on the first surface of the base member. According to the present invention as described above, it is possible to provide a liquid discharge head in which the density of piezoelectric members to be disposed is increased, and a method for manufacturing the same.

Further features of the present invention will become apparent from the following description of exemplary embodiments with reference to the attached drawings.

DESCRIPTION OF EMBODIMENTS

Specific embodiments of the present invention will now be described with reference to the drawings.

First Embodiment

Hereinafter, a liquid discharge head, a liquid discharge apparatus, and a method for manufacturing a liquid discharge head according to a first embodiment of the present invention will be described with reference to the drawings.

Figure 1:
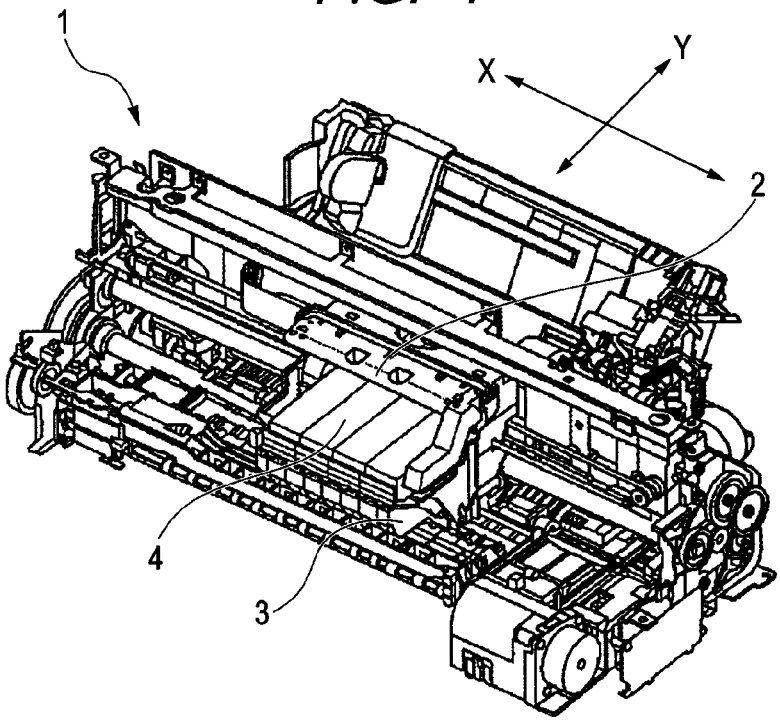
FIG. 1 is a perspective view of an ink jet recording apparatus according to an embodiment of the present invention.

FIG. 1 is a perspective view of an ink jet recording apparatus 1. The ink jet recording apparatus 1 is provided with a carriage 2 capable of scanning a recording medium (not illustrated) such as a recording sheet. The carriage 2 incorporates a liquid discharge head 3 for discharging liquid such as ink, and ink tanks 4 for supplying ink to the liquid discharge head 3.

The ink tanks 4 are capable of supplying multiple types of ink, such as cyan (C), magenta (M), yellow (Y), and black (K), to the liquid discharge head 3. The liquid discharge head 3 is prepared so as to correspond to the respective types of ink. The liquid discharge head 3 is mounted in the carriage 2, and discharges ink while scanning a recording medium, thereby performing recording on the recording medium.

The ink jet recording apparatus 1 is capable of conveying the recording medium in a sub-scanning direction (Y-direction illustrated in FIG. 1), and is also capable of scanning the carriage 2 in a main scanning direction (X-direction illustrated in FIG. 1) which intersects with the sub-scanning direction.

The ink jet recording apparatus 1 performs recording on the recording medium by causing the liquid discharge head 3 to discharge ink while moving the carriage 2 in the main scanning direction. The liquid discharge head 3 discharges ink at a predetermined timing based on binary divided recording data obtained by converting image data. Upon completion of one scanning of the liquid discharge head 3 in the main scanning direction, the ink jet recording apparatus 1 conveys the recording medium in the sub-scanning direction only by a predetermined amount.

After that, discharge of ink onto the recording medium in the main scanning direction by the liquid discharge head 3 and conveyance of the recording medium in the sub-scanning direction by the predetermined amount are repeated to thereby sequentially form images.

Figure 2A:
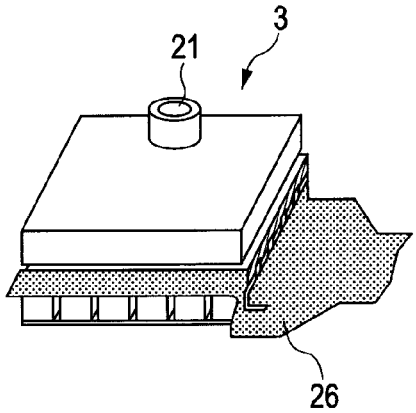
FIG. 2A is an exterior perspective view and a sectional view of a liquid discharge head according to a first embodiment, respectively.
Figure 2B:
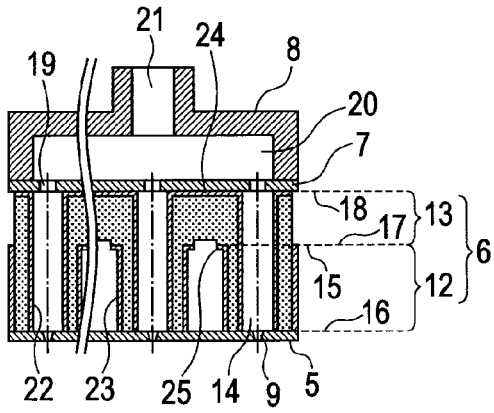
FIG. 2B is an exterior perspective view and a sectional view of a liquid discharge head according to a first embodiment, respectively.
Figure 3:
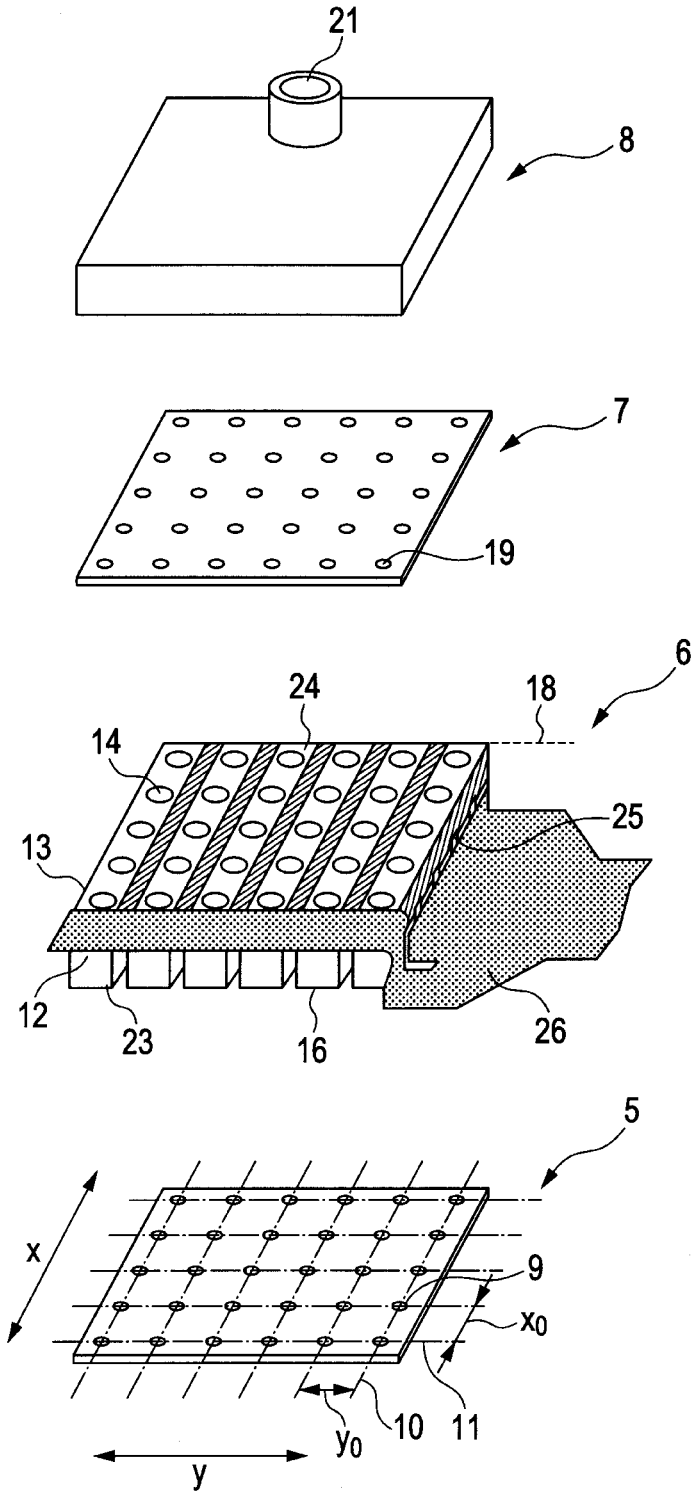
FIG. 3 is an exploded perspective view of the liquid discharge head according to the first embodiment.

FIG. 2A is an exterior perspective view of the liquid discharge head 3 according to the first embodiment of the present invention, and FIG. 2B is a sectional view of the liquid discharge head 3. FIG. 3 is an exploded perspective view of the liquid discharge head 3 according to the first embodiment.

As illustrated in FIGS. 2A to 2B and 3, the liquid discharge head 3 has a structure in which a nozzle plate 5, a piezoelectric element plate 6, a fluid control plate 7, and a liquid supply box 8 are stacked in this order and adjacent members are joined together.

The nozzle plate 5 includes multiple nozzles 9 each formed of a circular through-hole. The nozzles 9 are disposed along a first direction (x-direction illustrated in FIG. 3) at predetermined intervals $x_0$, thereby forming multiple first direction rows 10. The nozzles 9 are also disposed along a second direction (y-direction illustrated in FIG. 3), which intersects with the x-direction, at predetermined intervals $y_0$, thereby forming multiple second direction rows 11.

The piezoelectric element plate 6 is formed of piezoelectric members 12 disposed at positions corresponding to the respective nozzles 9, and a base member 13 which is adjacent to the piezoelectric members 12. The piezoelectric members 12 each include pressure chambers 14 for applying a pressure for discharging fluid to the fluid. Further, the piezoelectric members 12 each include a first surface 15 having an inlet for introducing the fluid into the pressure chambers 14, and a second surface 16 positioned on the opposite side of the first surface 15 and having an outlet for discharging the fluid from the pressure chambers 14. That is, the pressure chambers 14 are each formed of a through-hole which penetrates through the first surface 15 and the second surface 16.

The multiple piezoelectric members 12 are arranged so that flow directions (directions from the first surface toward the second surface 16) of fluid flowing through the pressure chambers 12 are arranged along one another. Further, the piezoelectric members 12 are arranged in the first direction (x-direction) intersecting with the flow directions and in the second direction (y-direction) intersecting with the flow directions and the first direction.

In the base member 13, a first surface 17 of the base member 13 and the first surface 15 of each of the piezoelectric members 12 are adjacent to each other. Additionally, the base member 13 has openings which are formed in a second surface 18 positioned on the opposite side of the first surface 17 and which communicate with the respective pressure chambers 14. The second surface 16 of each of the piezoelectric members 12 is joined with the nozzle plate 5, and the second surface 18 of the base member 13 is joined with the fluid control plate 7.

The pressure chambers 14 are each formed of a cylindrical space having a diameter larger than the opening diameter of each of the nozzles 9. The diameter and the length in a discharge direction of the pressure chambers 14 are adjusted to thereby stabilize discharge of ink and increase the critical frequency during discharge of ink.

The piezoelectric members 12 are each formed of a piezoelectric element which contracts upon being applied with an electric field in the radial direction of the pressure chambers 14, each of which is formed in a cylindrical shape. The piezoelectric element plate 6 can be obtained in various ways, such as joining the piezoelectric members 12 with the base member 13, or forming grooves in a plate made of a piezoelectric material to use remaining portions as the piezoelectric members 12.

The fluid control plate 7 includes flow rate adjustment holes 19 which are formed at positions corresponding to the respective pressure chambers 14 and are each formed of a hole having a diameter smaller than that of each of the pressure chambers 14. The piezoelectric members 12 and the flow rate adjustment holes 19 constitute the first direction rows 10 and the second direction rows 11 in the same manner as the nozzles 9.

The liquid supply box 8 has a recess having an opening formed in a surface in contact with the fluid control plate 7. When the liquid supply box 8 is adjoined to the fluid control plate 7, a space is formed between the recess and the fluid control plate 7. The space is referred to as a common liquid chamber 20. The common liquid chamber 20 communicates with the pressure chambers 14 through the flow rate adjustment holes 19.

Further, a liquid supply channel 21 communicating with the common liquid chamber 20 is provided in a surface of the liquid supply box 8 which is positioned on the opposite side of the surface in contact with the fluid control plate 7. The liquid supply channel 21 is connected to the ink tanks 4 (FIG. 1), and ink is supplied from the ink tanks 4 and the ink is accumulated in the common liquid chamber 20.

Accordingly, the ink supplied from the liquid supply channel 21 is accumulated in the common liquid chamber 20, and is then fed to the pressure chambers 14 through the flow rate adjustment holes 19. After that, the ink accumulated in the pressure chambers 14 is applied with a pressure from the piezoelectric members 12 and is discharged as ink droplets from the nozzles 9.

Here, the structure of the piezoelectric element plate 6 will be described in detail.

Figure 4:
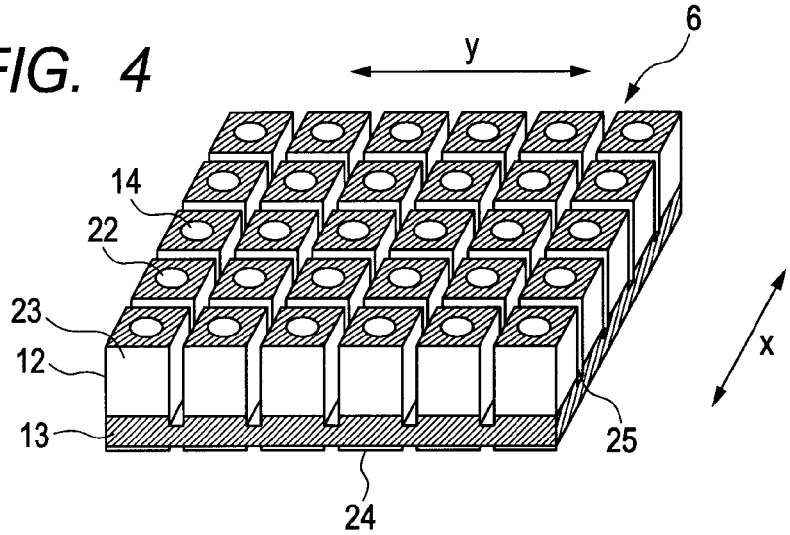
FIG. 4 is a perspective view of a piezoelectric element plate according to the first embodiment.

FIG. 4 is a perspective view of the surface in contact with the nozzle plate 5 of the piezoelectric element plate 6 illustrated in FIG. 3, i.e., the second surface 16 of the piezoelectric members 12, when viewed obliquely from above. The piezoelectric element plate 6 illustrated in FIG. 4 is a perspective view when the piezoelectric element plate 6 illustrated in FIG. 3 is inverted.

Figure 5A:
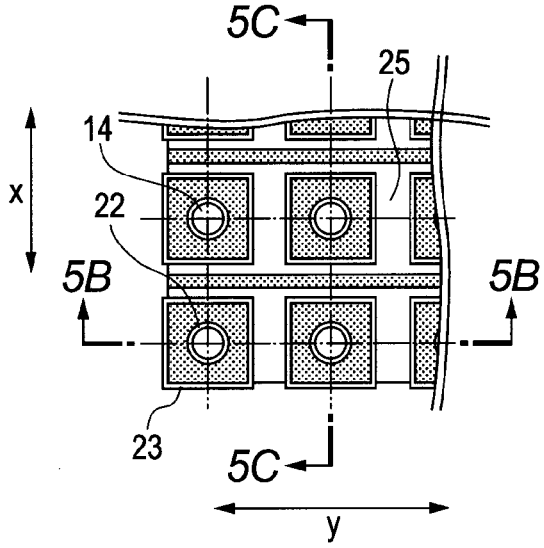
FIG. 5A is a plan view and sectional views of the piezoelectric element plate according to the first embodiment, respectively.
Figure 5C:
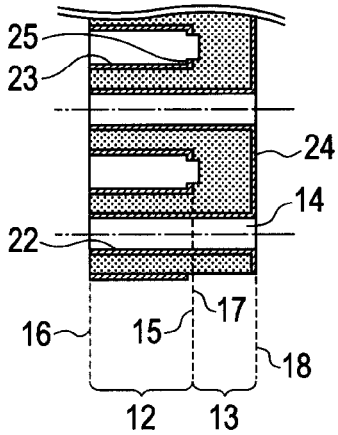
FIG. 5C is a plan view and sectional views of the piezoelectric element plate according to the first embodiment, respectively.
Figure 5B:
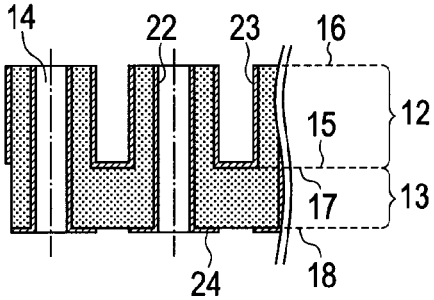
FIG. 5B is a plan view and sectional views of the piezoelectric element plate according to the first embodiment, respectively.

FIG. 5A is a plan view of the piezoelectric element plate 6 when the piezoelectric element plate 6 illustrated in FIG. 3 is viewed from the nozzle plate 5 toward the fluid control plate 7. FIGS. 5B and 5C are sectional views of the piezoelectric element plate 6 taken along the lines 5B-5B and 5C-5C in FIG. 5A, respectively.

As illustrated in FIGS. 5A to 5C, a first electrode 22 is provided on an inner surface side of each of the pressure chambers 14. Further, a second electrode 23 is provided outside the pressure chambers 14 in an area other than the second surface 16 of each of the piezoelectric members 12. The second electrode 23 is not formed at an opening edge on the side of the surface 16 of each of the pressure chambers 14. Accordingly, the first electrode 22 and the second electrode 23 are electrically isolated from each other.

On the second surface 18 of each of the base members 13, first common wiring lines 24 electrically connected to the first electrodes 22 are disposed.

The first common wiring lines 24 extend so as to connect the openings in the second surface 18 of each of the base members 13 of the pressure chambers 14 which are arranged in the x-direction. Accordingly, the first electrodes 22 provided in the piezoelectric members 12 which are adjacent to each other in the x-direction are electrically connected in common through the first common wiring lines 24, and the first electrodes 22 provided in the piezoelectric members 12 which are adjacent to each other in the y-direction are electrically isolated from each other.

Meanwhile, on the first surface 17 of each of the base members 13, second common wiring lines 25 electrically connected to the second electrodes 23 are disposed. The second common wiring lines 25 extend so as to connect the piezoelectric members 12 which are adjacent to each other in the y-direction. Accordingly, the second electrodes 23 provided in the piezoelectric members 12 which are adjacent to each other in the y-direction are electrically connected in common through the second common wiring lines 25, and the second electrodes 23 provided in the piezoelectric members 12 which are adjacent to each other in the x-direction are electrically isolated from each other.

The piezoelectric element plate 6 includes the multiple first common wiring lines 24 and the multiple second common wiring lines 25 so as to correspond to the arrangement of the piezoelectric members 12. Additionally, the first common wiring lines 24 are arranged in the y-direction, and the second common wiring lines 25 are arranged in the x-direction. In short, the piezoelectric element plate 6 has a matrix-shaped wiring structure of the first common wiring lines 24 and the second common wiring lines 25.

Further, as illustrated in FIG. 3, the piezoelectric element plate 6 is provided with a wiring member 26 which is electrically connected to each of the first common wiring lines 24 and the second common wiring lines 25. The wiring member 26 is capable of transmitting electrical signals separately for each of the first common wiring lines 24 extending in the x-direction and for each of the second common wiring lines 25 extending in the y-direction.

Next, the operation of the liquid discharge head 3 according to the first embodiment of the present invention will be described with reference to FIGS. 2A to 5C.

As illustrated in FIGS. 2A to 2B, ink is supplied from the liquid supply channel 21 to the common liquid chamber 20, and the ink is further supplied from the common liquid chamber 20 to the pressure chambers 14 through the flow rate adjustment holes 19. Accordingly, the ink is accumulated in the pressure chambers 14.

When the liquid discharge head 3 discharges ink, electrical signals are transmitted to desired first common wiring lines 24 and second common wiring lines 25, which are illustrated in FIGS. 5A to 5C, from a head control unit, which is not illustrated, through the wiring member 26. The piezoelectric members 12 including the first electrodes 22 connected to the first common wiring lines 24 having received the electrical signal and the second electrodes 23 connected to the second common wiring lines 25 having received the electrical signal are applied with an electric field and deformed.

The piezoelectric members 12 are deformed in the radial direction of the pressure chambers 14, and the volume of each of the pressure chambers 14 is contracted, thereby generating a pressure for discharging the ink accumulated in the pressure chambers 14. As a result, the ink is discharged as ink droplets from the nozzles 9 illustrated in FIGS. 2A to 2B and the ink is adhered to the recording medium.

After that, the transmission of electrical signals from the head control unit to the desired first common wiring lines 24 and second common wiring lines 25 is stopped, so that the shape of the piezoelectric members 12 is restored. The volume of each of the pressure chambers 14 is restored, and ink is supplied from the common liquid chamber 20 to the pressure chambers 14 through the flow rate adjustment holes 19.

The operation described above is repeated to discharge ink at the predetermined timing, thereby performing recording on the recording medium.

In the first embodiment, the number of wiring lines can be considerably reduced and the space for the routed wiring lines can be reduced as compared with the case where the wiring member 26 is separately connected to each of the first electrodes 22 and the second electrodes 23 which are provided in the respective piezoelectric members 12. As a result, the interval between the adjacent piezoelectric members 12 can be reduced and the nozzles 9 can be disposed at a higher density. Moreover, the number of wiring lines is reduced, which leads to a reduction in cost.

Additionally, there is no need to connect the wiring member 26 to each of the first electrodes 22 and second electrodes 23. Accordingly, a high accuracy for connecting the wiring member 26 is not required. As a result, the non-defective product ratio of the liquid discharge head can be increased, and the reliability in connection of the wiring member 26 with the first electrodes 22 and the second electrodes 23 can be improved.

Next, methods for manufacturing the piezoelectric element plate 6 and the liquid discharge head 3 according to the first embodiment will be described with reference to FIGS. 6A to 6F.

FIGS. 6A to 6F are views for illustrating the method for manufacturing the piezoelectric element plate 6. Note that in FIGS. 6A to 6F, white areas represent regions where an electrode, an electrode film, a wiring line, and the like are formed, and hatched areas represent regions where an electrode and the like are not formed.

Figure 6A:
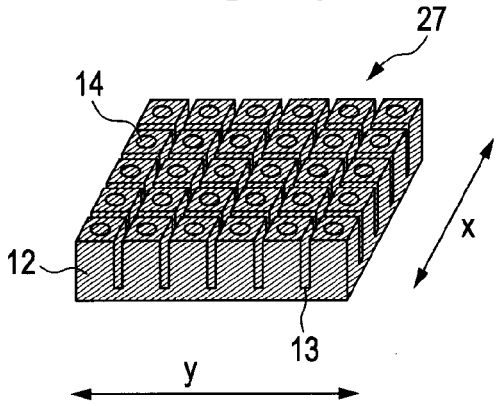
FIG. 6A is views for illustrating a method for manufacturing the piezoelectric element plate according to the first embodiment.

First, as illustrated in FIG. 6A, the piezoelectric member plate 27 which is composed of the piezoelectric members 12 and the base member 13 and in which an electrode and the like are not formed is prepared. The pressure chambers 14 are formed in the respective piezoelectric members 12.

Figure 6D:
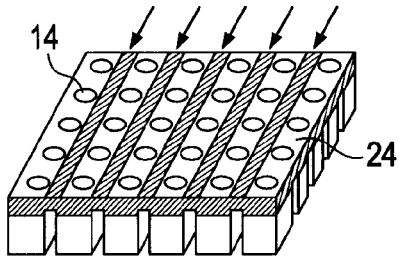
FIG. 6D is views for illustrating a method for manufacturing the piezoelectric element plate according to the first embodiment.
Figure 6B:
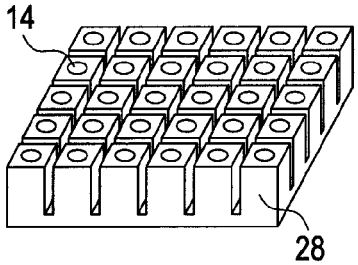
FIG. 6B is views for illustrating a method for manufacturing the piezoelectric element plate according to the first embodiment.

Next, as illustrated in FIG. 6B, on the entire surface of the piezoelectric member plate 27, an electrode film 28 serving as a base for the first electrode 22, the first common wiring line 24, and the like is formed. The electrode film 28 is formed by a method such as deposition or sputtering using metal such as Cu, Ti, or Cr. Further, Ni and Au films are formed by plating, for example, by using the electrode film 28 as a seed layer for plating.

The electrode film 28 which is formed on the inner surface of each of the piezoelectric members 12, i.e., on the surface forming each of the pressure chambers 14, serves as the first electrode 22, and the electrode film 28 formed on the outer surface of each of the piezoelectric members 12 serves as the second electrode 23.

Figure 6E:
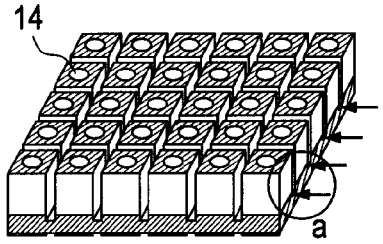
FIG. 6E is views for illustrating a method for manufacturing the piezoelectric element plate according to the first embodiment.
Figure 6C:
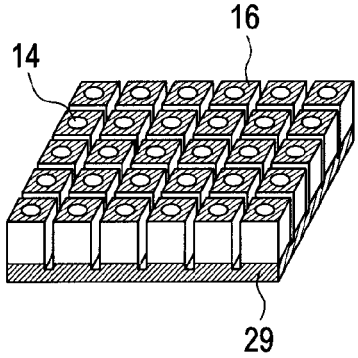
FIG. 6C is views for illustrating a method for manufacturing the piezoelectric element plate according to the first embodiment.

Subsequently, as illustrated in FIG. 6C, the electrode film 28 of the second surface 16 of each of the piezoelectric members 12 is removed by polishing the second surface 16 of each of the piezoelectric members 12. Further, the electrode film 28 formed on a side surface 29 of the base member 13 between the first surface 17 of the base member 13 and the second surface 18 of the base member 13 is removed by polishing or laser irradiation. The electrode film 28 formed on the second surface 16 of each of the piezoelectric members 12 and on the side surface 29 of the base member 13 is removed, thereby separating and electrically isolating the first electrodes 22 from the second electrodes 23.

FIG. 6D is a view in which the piezoelectric member plate 27 illustrated in FIGS. 6A to 6C is inverted. As illustrated in FIG. 6D, the electrode film 28 formed between the pressure chambers 14, which are adjacent to each other in the y-direction, on the second surface 18 of the base member 13 is continuously removed in strip shapes by machining such as laser irradiation or dicing.

The electrode film 28 remaining on the second surface 18 of the base member 13 serves as the first common wiring line 24. The electrode film 28 is removed in strip shapes in the x-direction, thereby separating and electrically isolating the first common wiring lines 24 neighboring in the y-direction.

Figure 6F:
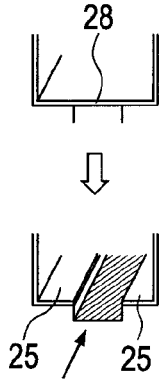
FIG. 6F is views for illustrating a method for manufacturing the piezoelectric element plate according to the first embodiment.

FIG. 6E is a view in which the piezoelectric member plate 27 illustrated in FIG. 6D is further inverted. As illustrated in FIG. 6E, the electrode film 28 formed between the piezoelectric members 12, which are adjacent to each other in the x-direction, on the first surface 17 of the base member 13 is continuously removed in strip shapes along the y-direction by machining such as dicing or wire cutting. FIG. 6F is an enlarged view of a portion "a" illustrated in FIG. 6E, and illustrates a state where the electrode film 28 on the first surface 17 of the base member 13 is removed.

The electrode film 28 remaining on the first surface 17 of the base member 13 serves as the second common wiring line 25. The electrode film 28 is removed in strip shapes along the y-direction, thereby separating and electrically isolating the second common wiring lines 25 neighboring in the x-direction.

Next, a polarization process for the piezoelectric members 12 is performed through the first electrodes 22 and the second electrodes 23. The polarization process is performed in the radial direction of the pressure chambers 14 each of which is formed in a cylindrical shape. Subsequently, a protective film for protecting the electrode film 28 from liquid supplied from the pressure chambers 14 is formed. Details of the polarization process step and the protective film forming step are omitted.

As the protective film, a low water-permeability film may be used. Specifically, an inorganic protective film including any one of silicon oxide, silicon nitride, and silicon oxynitride, or an organic protective film mainly composed of a parylene film, an organic SOG film, or an organic polymer film is used. Examples of the parylene film include parylene-N, parylene-C, parylene-D, and parylene-F. Examples of the organic SOG film include films based on alkylalkoxysilane or organosiloxane resin. Examples of the organic polymer film include polyimide.

Figure 7A:
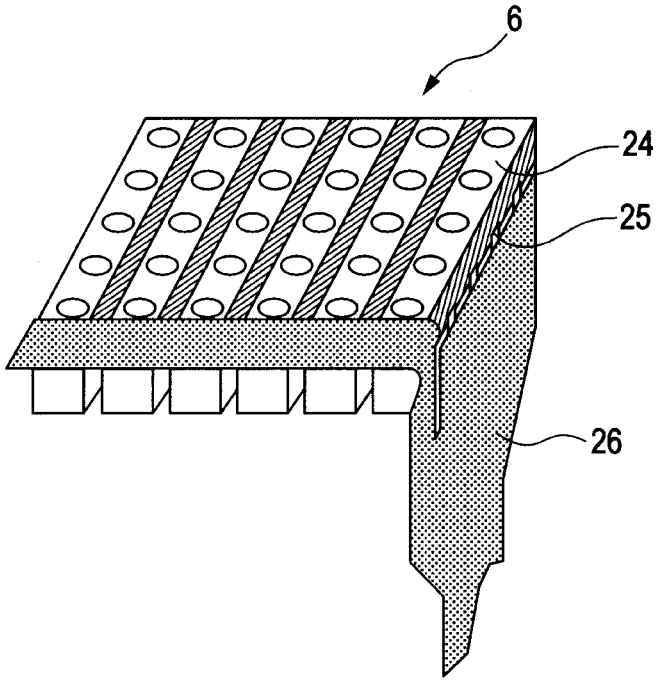
FIG. 7A is views for illustrating a step of connecting a wiring line to the piezoelectric element plate according to the first embodiment.
Figure 7B:
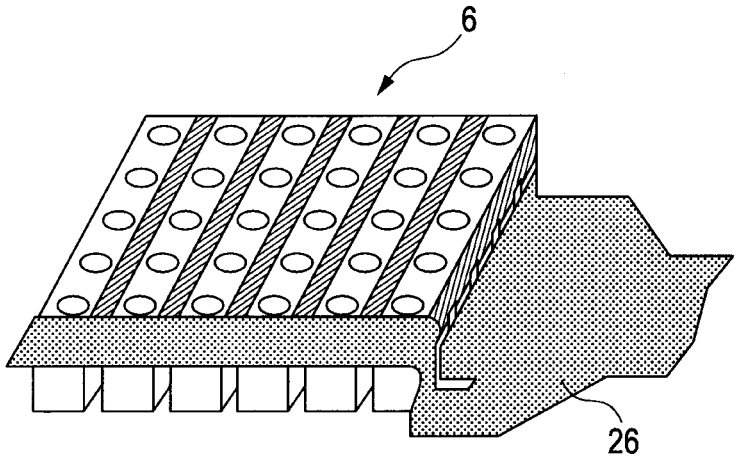
FIG. 7B is views for illustrating a step of connecting a wiring line to the piezoelectric element plate according to the first embodiment.

Next, as illustrated in FIG. 7A, the wiring member 26 is connected to each of the first common wiring lines 24 and the second common wiring lines 25 of the piezoelectric element plate 6. FIGS. 7A to 7B are perspective views of the piezoelectric element plate 6 connected with the wiring member 26. The first common wiring lines 24 or the second common wiring lines 25 are connected to the wiring member 26 by use of an adhesive for circuits, such as an anisotropic conductive film or anisotropic conductive paste, or solder by solder paste printing. A flexible wiring substrate with flexibility is used as the wiring member 26.

FIG. 7B illustrates a state where the wiring member 26 is connected to the piezoelectric element plate 6 and then the wiring member 26 is bent. The bending of the wiring member 26 facilitates stacking and joining of the nozzle plate 5 and the fluid control plate 7 illustrated in FIG. 3 onto the piezoelectric element plate 6.

Subsequently, as illustrated in FIG. 3, the fluid control plate 7 is joined to a side of the piezoelectric element plate 6 on the second surface 18 of the base member 13. At this time, the joining is performed by positioning the pressure chambers 14 and the flow rate adjustment holes 19 to communicate with each other.

Further, the nozzle plate 5 is joined to the first surface 15 of each of the piezoelectric members 12 of the piezoelectric element plate 6. The joining is performed by positioning the nozzles 9 and the pressure chambers 14 to communicate with each other.

Lastly, the liquid supply box 8 is joined to a surface of the fluid control plate 7 on the opposite side of the surface joined with the piezoelectric element plate 6, thereby manufacturing the liquid discharge head 3.

According to the first embodiment, the electrical isolation between the first electrodes 22 and the second electrodes 23 can be collectively performed by machining such as polishing or laser processing. This simplifies the manufacturing process as compared with the case where the first electrodes 22 and the second electrodes 23 are separately provided.

Furthermore, the first common wiring lines 24 can be collectively formed by machining such as laser irradiation or dicing. This simplifies the manufacturing process as compared with the case where the first common wiring lines 24 are separately disposed.

Similarly, the second common wiring lines 25 can be collectively formed by machining such as dicing or wire cutting.

This simplifies the manufacturing process as compared with the case where the second common wiring lines are separately disposed.

Second Embodiment

A liquid discharge head and a method for manufacturing a liquid discharge head according to a second embodiment of the present invention will now be described with reference to the drawings.

The liquid discharge head according to the second embodiment includes, in place of the piezoelectric element plate 6 illustrated in the first embodiment, a stacked piezoelectric element plate 30 in which the pressure chambers 14 are each formed of two different piezoelectric members 12. The stacked piezoelectric element plate 30, in which the pressure chambers 14 are each formed of the two piezoelectric members 12, is also called a double-actuator-type piezoelectric element plate.

Figure 8:
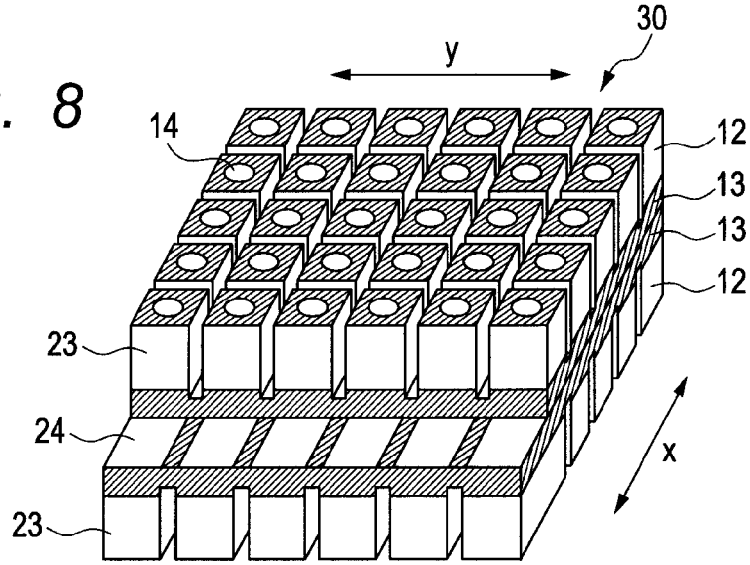
FIG. 8 is a perspective view of a stacked piezoelectric element plate according to a second embodiment.
Figure 9A:
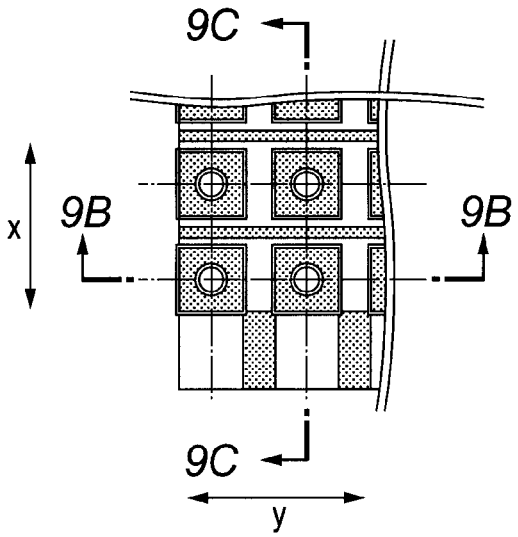
FIG. 9A is a plan view and a sectional view of the stacked piezoelectric element plate according to the second embodiment.
Figure 9C:
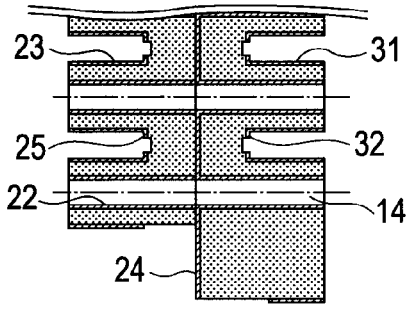
FIG. 9C is a plan view and a sectional view of the stacked piezoelectric element plate according to the second embodiment.
Figure 9B:
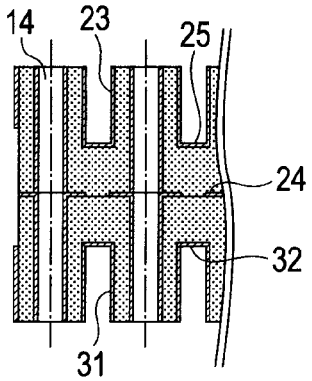
FIG. 9B is a plan view and a sectional view of the stacked piezoelectric element plate according to the second embodiment.

FIG. 8 is a perspective view of the stacked piezoelectric element plate 30 according to the second embodiment. FIGS. 9A to 9C are a plan view and a sectional view of the stacked piezoelectric element plate 30 illustrated in FIG. 8. FIGS. 9B and 9C are sectional views of the piezoelectric element plate 6 taken along the lines 9B-9B and 9C-9C in FIG. 9A, respectively.

As illustrated in FIGS. 8 and 9A to 9C, the stacked piezoelectric element plate 30 includes two piezoelectric element plates 6 described in the first embodiment and is formed by joining the second surfaces 18 of the base members 13 so as to face each other. The two piezoelectric element plates 6 are disposed such that the positions of the pressure chambers 14 coincide with each other and extending directions of the first common wiring lines 24 coincide with each other.

A width in the x-direction of one of the two piezoelectric element plates 6 is shorter than a width in the x-direction of the other piezoelectric element plate 6. Accordingly, a part of the second surface 18 of the base member 13 and a part of the first common wiring lines 24 of the other piezoelectric element plate 6 are exposed.

The first electrodes 22 provided in the respective piezoelectric members 12, the positions of which coincide with each other, are electrically connected to each other and function as a single electrode. Accordingly, the first common wiring lines 24 electrically connected to the first electrodes 22 are not necessarily formed on both the two piezoelectric element plates 6, and it is only necessary that the first common wiring lines be provided on at least the other piezoelectric element plate 6 where the second surface 18 of the base member 13 is exposed.

Further, the second electrodes 23 provided in the respective piezoelectric members 12, the positions of which coincide with each other, are electrically isolated from each other, and the second common wiring lines 25 provided on the two piezoelectric element plates 6 are also electrically isolated from each other.

Note that in the second embodiment, the second electrode 23 and the second common wiring line 25, which are provided on the other piezoelectric element plate 6, are referred to as a third electrode 31 and a third common wiring line 32, respectively. That is, the stacked piezoelectric element plate 30 has a matrix-shaped wiring structure including three layers of the first common wiring line 24, the second common wiring line 25, and the third common wiring line 32.

In the stacked piezoelectric element plate 30, electrical signals are transmitted to desired first common wiring lines 24, second common wiring lines 25, and third common wiring lines 32 through wiring lines which are not illustrated. The piezoelectric members 12 including the first electrodes 22 connected to the first common wiring lines having received the electrical signal and the second electrodes 23 connected to the second common wiring lines 25 having received the electrical signal are applied with an electric field and deformed.

Further, the piezoelectric members 12 including the first electrodes 22 connected to the first common wiring lines 24 having received the electrical signal and the third electrodes 31 connected to the third common wiring lines 32 having received the electrical signal are applied with an electric field and deformed.

The timings for transmitting electrical signals to the first common wiring lines 24, the second common wiring lines 25, and the third common wiring lines 32 are controlled, thereby enabling driving of the piezoelectric members 12 at desired positions and at desired timings.

In the second embodiment, as in the first embodiment, the number of wiring lines can be considerably reduced and the space for the routed wiring lines can be reduced as compared with the case where the wiring member 26 is separately connected to each of the first electrodes 22 and the second electrodes 23 which are provided in the respective piezoelectric members 12. As a result, the interval between the adjacent piezoelectric members 12 can be reduced and the nozzles 9 can be disposed at a higher density. Moreover, the number of wiring lines is reduced, which leads to a reduction in cost.

Additionally, there is no need to connect the wiring member 26 to each of the first electrodes 22 and second electrodes 23. Accordingly, a high accuracy for connecting the wiring member 26 is not required. As a result, the non-defective product ratio of the liquid discharge head can be increased, which leads to an improvement of the reliability in connection of the wiring member 26 with the first electrodes 22 and the second electrodes 23.

Moreover, in the second embodiment, each pressure chamber 14 includes two piezoelectric members 12 which are capable of pressurization separately. As compared with the pressure chamber 14 formed of a single piezoelectric member 12, the pressure chamber 14 formed of two piezoelectric members 12 can be contracted by the same amount at a low voltage. Accordingly, the use of the liquid discharge head of the second embodiment enables low power consumption. When the two piezoelectric members 12 are driven with a time lag, the critical frequency during discharge of ink can be increased.

Next, a method for manufacturing the stacked piezoelectric element plate 30 according to the second embodiment will be described with reference to FIGS. 10A to 10G. FIGS. 10A to 10G are views for illustrating the method for manufacturing the stacked piezoelectric element plate 30. In FIGS. 10A to 10G, white areas represent regions where an electrode, an electrode film, a wiring line, and the like are formed, and hatched areas represent regions where an electrode and the like are not formed.

Figure 10A:
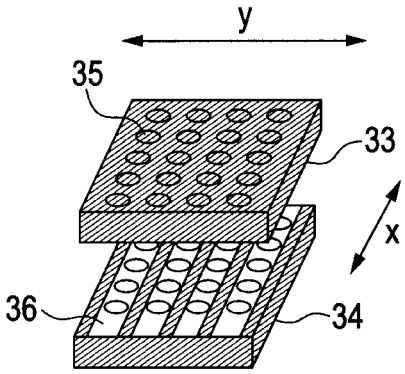
FIG. 10A is views for illustrating a method for manufacturing the stacked piezoelectric element plate according to the second embodiment.

First, as illustrated in FIG. 10A, a first piezoelectric member plate 33 and a second piezoelectric member plate 34 are prepared. The first and second piezoelectric member plates 33 and 34 include through-holes 35 which are two-dimensionally arranged in the x-direction and the y-direction. The through-holes 35 are disposed such that the positions of the through-holes 35 coincide with each other when the first and second piezoelectric member plates 33 and 34 are joined together.

On a surface of the second piezoelectric member plate 34 which is jointed with the first piezoelectric member plate 33, common electrode rows 36 are formed. The common electrode rows 36 extend in strip shapes so as to connect openings of the through-holes 35 arranged in the x-direction, and the common electrode rows 36 which are adjacent to each other in the y-direction are electrically isolated from each other. The first piezoelectric member plate 33 includes no electrode rows corresponding to the common electrode rows 36 of the second piezoelectric member plate 34.

A width in the x-direction of the second piezoelectric member plate 34 is greater than a width in the x-direction of the first piezoelectric member plate 33.

Figure 10B:
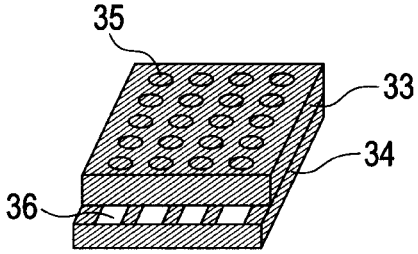
FIG. 10B is views for illustrating a method for manufacturing the stacked piezoelectric element plate according to the second embodiment.

Next, as illustrated in FIG. 10B, the first piezoelectric member plate 33 and the second piezoelectric member plate 34 are stacked and joined so that the through-holes 35 communicate with each other. Since the width in the x-direction of the second piezoelectric member plate 34 is greater than the width in the x-direction of the first piezoelectric member plate 33, each end in the x-direction of the common electrode rows 36 is exposed.

Figure 10C:
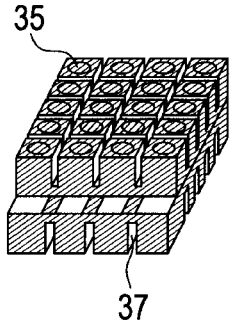
FIG. 10C is views for illustrating a method for manufacturing the stacked piezoelectric element plate according to the second embodiment.

Next, as illustrated in FIG. 10C, circumference grooves 37 are formed so as to pass between the through-holes 35, which are adjacent to each other in the x-direction and the y-direction, of the first piezoelectric member plate 33. The circumference grooves 37 are each formed with a depth so as not to penetrate through the first piezoelectric member plate 33 in a direction from the surface of the first piezoelectric member plate 33 on the opposite side of the surface in contact with the second piezoelectric member plate 34 toward the surface in contact with the second piezoelectric member plate 34.

The piezoelectric members 12 and the base member 13 illustrated in FIG. 8 are formed by forming the circumference grooves 37. The circumference grooves 37 can be formed by machining such as dicing or wire sawing.

Similarly, the circumference grooves 37 are formed in the second piezoelectric member plate 34. The circumference grooves 37 are formed in the x-direction and the y-direction with a depth so as not to penetrate through the second piezoelectric member plate 34 in a direction from the surface of the second piezoelectric member plate 34 on the opposite side of the surface in contact with the first piezoelectric member plate 33 toward the surface in contact with the first piezoelectric member plate 33.

Figure 10D:
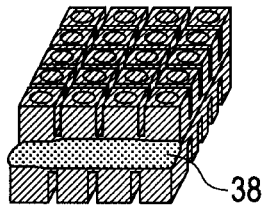
FIG. 10D is views for illustrating a method for manufacturing the stacked piezoelectric element plate according to the second embodiment.

Subsequently, as illustrated in FIG. 10D, a resist material 38 for covering the exposed portions of the common electrode rows 36 is coated.

Figure 10E:
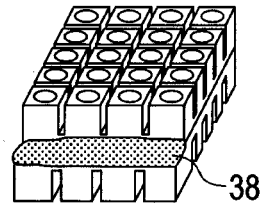
FIG. 10E is views for illustrating a method for manufacturing the stacked piezoelectric element plate according to the second embodiment.

After that, as illustrated in FIG. 10E, on the outer surfaces of the first and second piezoelectric member plates 33 and 34, the electrode film 28 is formed. The electrode film 28 is not formed on the surface where the first piezoelectric member plate 33 and the second piezoelectric member plate 34 are stacked and joined and on the surface where the resist material 38 is coated.

The electrode film 28 is formed by a method such as deposition or sputtering using metal such as Cu, Ti, or Cr. Further, Ni and Au films are formed by plating, for example, by using the electrode film 28 as a seed layer for plating.

At this time, the electrode film 28 is also formed on the inner surface of each of the through-holes 35. The common electrode rows 36 are also formed around the through-holes 35, thereby electrically connecting the electrode film 28, which is formed on the inner surface of the through-hole 35, with the common electrode rows 36.

Figure 10F:
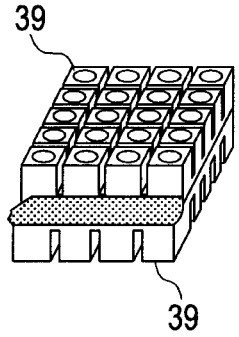
FIG. 10F is views for illustrating a method for manufacturing the stacked piezoelectric element plate according to the second embodiment.

Next, as illustrated in FIG. 10F, the electrode film 28 formed on the surface 39 of the first piezoelectric member plate 33 where the openings of the through-holes 35 are positioned is removed by polishing. Thus, the electrode film 28 formed on the outer surfaces of the piezoelectric members 12 and the electrode film 28 formed on the inner surfaces of the through-holes 35 are separated and electrically isolated from each other. Similarly, the electrode film 28 formed on the surface 39 of the second piezoelectric member plate 34 where the openings of the through-holes 35 are positioned is removed.

Figure 10G:
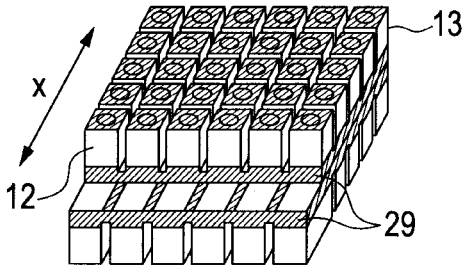
FIG. 10G is views for illustrating a method for manufacturing the stacked piezoelectric element plate according to the second embodiment.

Subsequently, as illustrated in FIG. 10G, the electrode film 28 formed on the side surface 29 of each of the first and second piezoelectric member plates 33 and 34 which is adjacent to the surface on which the base members 13 are stacked and joined is continuously removed in strip shapes by machining such as laser light or dicing.

Furthermore, the electrode film 28 formed between the piezoelectric members 12, which are adjacent to each other in the x-direction, of the first surface 17 of the base member 13 of the first piezoelectric member plate 33 is continuously removed in strip shapes along the y-direction by machining such as dicing or wire sawing. Similarly, the electrode film 28 formed between the piezoelectric members 12, which are adjacent to each other in the x-direction, on the first surface 17 of the base member 13 of the second piezoelectric member plate 34 is continuously removed in strip shapes along the y-direction.

After that, a polarization process for the piezoelectric members 12 is performed through the first electrodes 22 and the third electrodes 31 or the first electrodes 22 and the third electrodes 31. The polarization process is performed in the radial direction of the through-holes 35 each of which is formed in a cylindrical shape. Further, a protective film for protecting the electrode film 28 from liquid supplied from the through-holes 35 is formed. Details of the polarization process step and the protective film forming step are omitted.

As the protective film, a low water-permeability film may be used. Specifically, an inorganic protective film including any one of silicon oxide, silicon nitride, and silicon oxynitride, or an organic protective film mainly composed of a parylene film, an organic SOG film, or an organic polymer film is used. Examples of the parylene film include parylene-N, parylene-C, parylene-D, and parylene-F. Examples of the organic SOG film include films based on alkylalkoxysilane or organosiloxane resin. Examples of the organic polymer film include polyimide.

After that, the wiring member 26, the nozzle plate 5, the fluid control plate 7, and the liquid supply box 8 illustrated in FIG. 3 are stacked on the stacked piezoelectric element plate 30, thereby producing the liquid discharge head 3. Details of the stacking steps are the same as those of the first embodiment, so the description thereof is omitted.

According to the second embodiment, as in the first embodiment, the electrical isolation between the first electrodes 22, the second electrodes 23, and the third electrodes 31 can be collectively performed by machining such as polishing or laser processing. Accordingly, the manufacturing process can be simplified as compared with the case where the first electrodes 22, the second electrodes 23, and the third electrodes 31 are separately provided.

Further, the first common wiring lines 24 can be collectively formed by machining such as laser or dicing, before the first piezoelectric member plate 33 and the second piezoelectric member plate 34 are joined together. Accordingly, the manufacturing process can be simplified as compared with the case where wiring lines are disposed on the first electrodes 22.

Similarly, the second common wiring lines 25 and the third common wiring lines 32 can be collectively formed by machining such as dicing or wire sawing. This simplifies the manufacturing process as compared with the case where the wiring lines are disposed on each of the second electrodes 23 and the third electrodes 31.

In the embodiments described above, the ink jet recording apparatus that discharges ink for recording an image has been described as a droplet discharge apparatus for discharging liquid, and the liquid discharge head for discharging ink for recording an image has been described as a droplet discharge head for discharging droplets. However, the liquid discharge apparatus and the droplet discharge head according to the present invention are not limited to those for recording an image on a recording sheet, and the liquid to be discharged is not limited to ink.

Examples are an apparatus for producing a color filter for display by discharging ink onto a polymer film or glass, and an apparatus for forming bumps for component mounting by discharging solder in a solution state onto a substrate. The present invention can be applied to a liquid discharge apparatus industrially used and to the overall liquid discharge heads used for the liquid discharge apparatus.

The present invention is not limited to the embodiments described above, but may be varied, changed, and modified in various manners without departing from the gist of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-133020, filed Jun. 10, 2010, which is hereby incorporated by reference herein in its entirety.

REFERENCE SIGNS LIST

3 liquid discharge head
10 first direction row
11 second direction row
12 piezoelectric member
13 base member
14 pressure chamber
22 first electrode
23 second electrode
24 first common wiring line
25 second common wiring line
x first direction (x-direction)
y second direction (y-direction)

The invention claimed is:

1. A liquid discharge head including a plurality of piezoelectric members each including a pressure chamber for applying to liquid a pressure for discharging the liquid, a first electrode provided on an inner surface side of the pressure chamber, and a second electrode provided outside the pressure chamber, the piezoelectric members generating the pressure by being deformed using the first electrode and the second electrode and being arranged in a first direction intersecting with a liquid flow direction and in a second direction intersecting with each of the liquid flow direction and the first direction so that the flow directions of the liquid flowing through the pressure chambers of the piezoelectric members are arranged along one another, the liquid discharge head comprising:

a plurality of first common wiring lines commonly connected to the plurality of first electrodes arranged in the first direction; and a plurality of second common wiring lines commonly connected to the plurality of second electrodes arranged in the second direction, wherein the plurality of first common wiring lines is arranged in the second direction, and the plurality of second common wiring lines is arranged in the first direction.

2. The liquid discharge head according to claim 1, wherein the piezoelectric members each include a first surface having an inlet for introducing the liquid into the pressure chamber and a second surface positioned on an opposite side of the first surface and having an outlet for discharging the liquid from the pressure chamber, the liquid discharge head further comprises a base member including a first surface adjacent to the first surface of each of the piezoelectric members, the base member has an opening which is formed on a second surface positioned on an opposite side of the first surface of the base member and which communicates with each of the pressure chambers, and the first common wiring lines are formed on the second surface of the base member, and the second common wiring lines are formed on the first surface of the base member.

3. The liquid discharge head according to claim 2, the liquid discharge head being structured such that two base members are joined together so that the second surfaces of the base members face each other, and each of the pressure chambers is formed of two of the piezoelectric members, wherein the first electrodes of the two piezoelectric members are electrically connected to each other, and the second electrodes of the two piezoelectric members are electrically isolated from each other.

4. The liquid discharge head according to claim 3, wherein the first electrodes are electrically connected to the first common wiring lines on the second surface of the base member, the second electrode of one of the two piezoelectric members is connected to the second common wiring line formed on the first surface of the base member adjacent to one of the two piezoelectric members, and the second electrode of the other of the two piezoelectric members is connected to the second common wiring line formed on the first surface of the base member adjacent to the other of the two piezoelectric members.

5. A method for manufacturing a liquid discharge head, the liquid discharge head comprising a plurality of piezoelectric members each including a pressure chamber for applying to liquid pressure for discharging the liquid, a first electrode provided on an inner surface side of the pressure chamber, and a second electrode provided outside the pressure chamber, the piezoelectric members generating the pressure by being deformed using the first electrode and the second electrode, and a base member adjacent to the piezoelectric members, the piezoelectric members each further including a first surface having an inlet for introducing the liquid into the pressure chamber, and a second surface positioned on an opposite side of the first surface and having an outlet for discharging the liquid from the pressure chamber, a first surface of the base member being adjacent to the first surface of each of the piezoelectric members, and a second surface of the base member on an opposite side of the first surface having an opening communicating with each of the pressure chambers, the plurality of piezoelectric members being arranged in a first direction intersecting with a liquid flow direction and in a second direction intersecting with each of the liquid flow direction and the first direction so that the flow directions of the liquid flowing through the pressure chambers of the piezoelectric members are arranged along one another, the liquid discharge head including a plurality of first common wiring lines commonly connected to the plurality of first electrodes arranged in the first direction; and a plurality of second common wiring lines commonly connected to the plurality of second electrodes arranged in the second direction, the plurality of first common wiring lines being formed on the second surface of the base member, the plurality of second common wiring lines being formed on the first surface of the base member, the method comprising the steps of:

forming an electrode film on an entire surface of each of the piezoelectric members and the base member;

removing the electrode film formed on the second surface of each of the piezoelectric members to separate the first electrodes from the second electrodes;

removing the electrode film formed on a side surface of the base member between the first surface of the base member and the second surface of the base member to separate the first common wiring lines from the second common wiring lines;

forming the first common wiring lines by removing along the first direction the electrode film formed between openings adjacent to each other in the second direction on the second surface of the base member; and forming the second common wiring lines by removing along the second direction the electrode film formed between the piezoelectric members adjacent to each other in the first direction on the first surface of the base member.

6. The method for manufacturing a liquid discharge head according to claim 5, wherein when the first common wiring lines are formed, the electrode film is continuously removed in strip shapes by one of laser irradiation and dicing.

7. The method for manufacturing a liquid discharge head according to claim 5, wherein the liquid discharge head comprises:

a fluid control plate joined with the second surface of the base member and having a flow rate adjustment hole communicating with the pressure chamber;

a liquid supply box joined to a surface of the fluid control plate on an opposite side of the surface joined with the base member, for supplying fluid to the pressure chamber through the fluid control plate; and a nozzle plate joined with the second surface of the piezoelectric member and having nozzles for discharging the liquid, and the method further comprising the steps of:

after the step of forming the second common wiring lines, joining the liquid supply plate to the second surface of the base member;

joining the liquid supply box to a surface of the fluid control plate on an opposite side of the surface joined with the base member; and joining the nozzle plate to the second surface of each of the piezoelectric members.

8. The method for manufacturing a liquid discharge head according to claim 5, wherein when the first electrodes and the second electrodes are separated from each other, the electrode film is removed by polishing.

9. The method for manufacturing a liquid discharge head according to claim 5, wherein when the first common wiring lines and the second common wiring lines are separated from each other, the electrode film is removed by one of polishing and laser irradiation.

10. The method for manufacturing a liquid discharge head according to claim 5, wherein when the second common wiring lines are formed, the electrode film is continuously removed in strip shapes by one of dicing and wire cutting.

11. The method for manufacturing a liquid discharge head according to claim 5, comprising the step of performing a polarization process on the piezoelectric members through the first electrodes and the second electrodes after the step of forming the second common wiring lines.

12. The method for manufacturing a liquid discharge head according to claim 5, wherein the electrode film is formed by one of sputtering, deposition, and plating.

13. The method for manufacturing a liquid discharge head according to claim 5, comprising the step of forming a protective film for protecting the electrode film from liquid supplied to the pressure chamber, after the step of forming the second common wiring lines.

14. The method for manufacturing a liquid discharge head according to claim 13, wherein the protective film comprises a low water-permeability film.

15. The method for manufacturing a liquid discharge head according to claim 13, wherein the protective film comprises one of silicon oxide, silicon nitride, and silicon oxynitride.

16. The method for manufacturing a liquid discharge head according to claim 13, wherein the protective film is an organic protective film mainly composed of one of parylene-N, parylene-C, parylene-D, parylene-F, a parylene film, an organic SOG film based on alkylalkoxysilane or organosiloxane resin, and an organic polymer film made of polyimide.

17. The method for manufacturing a liquid discharge head according to claim 5, comprising the step of connecting a wiring line to the first common wiring lines and the second common wiring lines by using one of an anisotropic conductive film, anisotropic conductive paste, and solder paste, after the step of forming the second common wiring lines.

18. A method for manufacturing a liquid discharge head, the liquid discharge head comprising a plurality of piezoelectric members each including a pressure chamber for applying to liquid pressure for discharging the liquid, a first electrode provided on an inner surface side of the pressure chamber, and a second electrode provided outside the pressure chamber, the piezoelectric members generating the pressure by being deformed using the first electrode and the second electrode, and a base member adjacent to the piezoelectric members, the piezoelectric members each further including a first surface having an inlet for introducing the liquid into the pressure chamber, and a second surface positioned on an opposite side of the first surface and having an outlet for discharging the liquid from the pressure chamber, a first surface of the base member being adjacent to the first surface of each of the piezoelectric members, a second surface of the base member on an opposite side of the first surface having an opening communicating with each of the pressure chambers, the plurality of piezoelectric members being arranged in a first direction intersecting with a liquid flow direction and in a second direction intersecting with each of the liquid flow direction and the first direction so that the flow directions of the liquid flowing through the pressure chambers of the piezoelectric members are arranged along one another, the liquid discharge head further including:

a first common wiring line provided on a second surface of one base member of two base members and commonly connected to the plurality of first electrodes arranged in the first direction, each of the pressure chambers being formed of two of the piezoelectric members by joining the two base members with each other so that the second surfaces of the base members face each other, the first electrodes of the two piezoelectric members being electrically connected to each other, the second electrodes of the two piezoelectric members being electrically isolated from each other, a second common wiring line provided on the first surface of the base member of one of the two base members, the second common wiring line being commonly connected to the plurality of second electrodes of the piezoelectric members adjacent to the one base member and being arranged in the second direction, and a second common wiring line provided on the first surface of the other base member of the two base members, the second common wiring line being commonly connected to the plurality of second electrodes of the piezoelectric members adjacent to the other base member and being arranged in the second direction, the method comprising the steps of:

preparing a first piezoelectric member plate having through-holes each serving as one of the pressure chambers, and an electrode row extending in a strip shape so as to connect openings of the through-holes arranged in the first direction on one surface;

preparing a second piezoelectric member plate having through-holes each serving as one of the pressure chambers, and having a width in the first direction which is smaller than a width in the first direction of the first piezoelectric member plate;

joining the first piezoelectric member plate and the second piezoelectric member plate with the one surface being sandwiched therebetween so that the through-holes coincide with each other;

forming the piezoelectric members and the base members by forming a circumference groove which passes between the through-holes adjacent to each other in the first direction and the second direction of the first piezoelectric member plate and the second piezoelectric member plate and which does not penetrate through each of the piezoelectric member plates;

forming an electrode film on an entire surface of each of the piezoelectric members and the base members;

removing the electrode film formed on the second surface of each of the piezoelectric members to separate the first electrodes from the second electrodes;

removing the electrode film formed on a side surface of the base members between the first surface of the base members and the second surface of the base members to separate the first common wiring line from the second common wiring lines; and forming the second common wiring lines by removing along the second direction the electrode film formed on the first surface of the base members between the piezoelectric members adjacent to each other in the first direction.

19. The method for manufacturing a liquid discharge head according to claim 18, wherein the liquid discharge head comprises:

a fluid control plate joined with the second surface of one of the piezoelectric members and having a flow rate adjustment hole communicating with the pressure chamber;

a liquid supply box joined to a surface of the fluid control plate on an opposite side of the surface joined with the base members, for supplying fluid to the pressure chamber through the fluid control plate; and a nozzle plate joined with the second surface of the other of the piezoelectric members and having nozzles for discharging the liquid, and the method further comprising the steps of:

after the step of forming the second common wiring lines, joining the liquid supply plate to the second surface of the base members;

joining the liquid supply box to a surface of the fluid control plate on an opposite side of the surface joined with the base members; and joining the nozzle plate to the second surface of the other of the piezoelectric members.

20. The liquid discharge head according to claim 18, comprising the steps of:

forming a resist material for covering the electrode row exposed when the first piezoelectric member plate and the second piezoelectric member plate are joined together, before the step of forming the electrode film; and removing the resist material after the step of forming the electrode film.

* * * * *